United States Patent [19]

Morisod

[11] Patent Number: 4,838,747

[45] Date of Patent: Jun. 13, 1989

[54] DEVICE FOR TRANSPORTING AND FORMING BATCHES OF FLAT PIECES WITH DECREASING THICKNESS

[75] Inventor: Jean-Bernard Morisod, Crissier, Switzerland

[73] Assignee: Bobst SA, Switzerland

[21] Appl. No.: 168,512

[22] Filed: Mar. 15, 1988

[30] Foreign Application Priority Data

Mar. 16, 1987 [CH] Switzerland ..... 00979/87

[51] Int. Cl.[4] ..... B65G 61/00

[52] U.S. Cl. ..... 414/790.3; 414/761; 414/762; 414/773; 414/788.3; 414/791.2; 414/901

[58] Field of Search ..... 414/31, 46, 54, 761, 414/762, 764, 765, 767, 773

[56] References Cited

U.S. PATENT DOCUMENTS

| | | | |
|---|---|---|---|
| 3,166,206 | 1/1965 | Porter et al. | 414/31 X |
| 3,547,279 | 12/1970 | Radomski | 414/765 |
| 3,805,982 | 4/1974 | Tolf et al. | 414/765 X |
| 3,970,202 | 7/1976 | Speggiorin et al. | 414/31 |
| 4,264,255 | 4/1981 | Saro et al. | 414/31 |
| 4,364,702 | 12/1982 | Coussot | 414/762 X |
| 4,474,521 | 10/1984 | Jaton | 414/31 |

*Primary Examiner*—Frank E. Werner
*Assistant Examiner*—Janice Krizek
*Attorney, Agent, or Firm*—Hill, Van Santen, Steadman & Simpson

[57] ABSTRACT

The present invention is directed to a device for transporting and forming batches of flat pieces with decreasing thickness. The device has a piling unit having a rotatably mounted double storage device for receiving two batches of flat pieces, one after the other, so that the first batch is placed on the second batch in a head-to-toe relationship to form a double batch for bundling.

9 Claims, 5 Drawing Sheets

DEVICE FOR TRANSPORTING AND FORMING BATCHES OF FLAT PIECES WITH DECREASING THICKNESS

BACKGROUND OF THE INVENTION

The present invention is directed to a device for forming batches of flat pieces with decreasing thickness, such as box blanks, which are delivered from a processing machine.

These flat pieces can be processed either manually or automatically. In the manual processing, an operator takes a first batch of flat pieces, which has already been counted by the machine processing them and then arranges them in a storage device. Then a second batch is placed head-to-tail on top of the first batch, in order to form an almost rectangular parallelipiped. The packet formed by these two batches are then tied up or bundled.

An automatic processing is performed by a device which is located between the machine processing the flat pieces and a tying or bundling unit. The automatic processing unit will transfer the batches into the store. Devices for automatically processing the batches are disclosed in Swiss Patent 572,433, which was the basis of U.S. Pat. No. 3,970,202; Swiss Patent 646,389, which was the basis of U.S. Pat. No. 4,474,521; and German Printed Application 28 27 540, which was the basis of U.S. Pat. No. 4,264,255. The disclosures of each of the three above-mentioned U.S. Patents is incorporated by reference thereto.

In U.S. Pat. No. 4,474,521, a device which suerimposes flat pieces with decreasing thickness in a head-to-tail arrangement of half packets is disclosed. This horizontal conveyance between the processing machine and the bundling unit is achieved by a set of grippers taking a half packet each in a continuous move in a non-stop production. During the transfer, every other gripper pivots through 180° in order to form regular piles with two half packets superimposed in a head-to-tail relationship.

In U.S. Pat. No. 4,264,255, a device which assembles half batches of flat pieces with decreasing thickness by means of a horizontally pivotable table is disclosed. While one-half of a packet is loaded, the table then pivots so that the second half packet can be laid down head-to-tail on top of the first half to form the complete batch, which can then be discharged.

The advantage of these two devices is that they allow a continuous production and do not need an operator to transfer the batches from the processing machine to the tying or bundling unit. These devices have, nonetheless, various drawbacks. They are quite bulky and their installation is complicated and expensive and requires heavy mechanical strengths imposed by the inertia of their particular elements, as well as the number and dimension of the movable elements. In one of the above examples, the half packets are not necessarily positioned adequately with regard to each other and this creates additional difficulties during the bundling operation because of possible cutting of the edges of the flat pieces.

SUMMARY OF THE INVENTION

The present invention is directed to reducing these drawbacks by means of a simple and less bulky device, which continuously maintains the half packets of flat pieces with decreasing thickness, and which device increases the production speed by reducing inertia of the moving elements as well as keeps a low cost and easy adjustments in the device when the format or size of the flat pieces are changed.

To accomplish these goals, the present invention is directed to an improvement in a device for transporting and forming batches of flat pieces with decreasing thickness, for instance to form batches of a counted number of folded boxes, which are delivered in a flow by a processing machine, including a rapid conveyor means, storing means and removing means. The improvements are that the conveyor means has an accelerating conveyor belt with an electrical control connected with the counting means and a removable shelf or gate activated by a piston for controlling the discharge of the batch from the conveyor, said shelf being located between the conveyor belt and a double store having two spaced groups of rollers extending between two frame members, one of said sub-frame members being an annular ring or crown, said sub-frame being mounted for rotation in a main frame, one end of the main frame adjacent the annular ring having an opening, said sub-frame having means for removing the batches from the store consisting of a carriage movable along a shaft and having pusher elements attached to the carriage for engaging the batches disposed in a double storage and pushing them out the opening as the carriage moves along said shaft, and means for shifting the carriage along the shaft.

In the preferred embodiment, the means for shifting the carriage includes a magneto-pneumatic piston, which is received in the hollow shaft, and the carriage has a cylinder surrounding the hollow shaft having a magnet which causes the carriage to move the piston as the piston is shifted within the hollow tube or axle.

To rotate the store, the sub-frame is mounted for rotation about an axis and has a chain drive connected to a pinion, which is rotated by a motor.

The rollers of the store are mounted in the sub-units, which can be adjusted due to changes in the height of each of the batches.

Other features and advantages of the invention will be readily apparent from the following description of the preferred embodiments, the drawings and claims.

DESCRIPTION OF THE PREFERRED EMBODIMENTS

Figure 1:
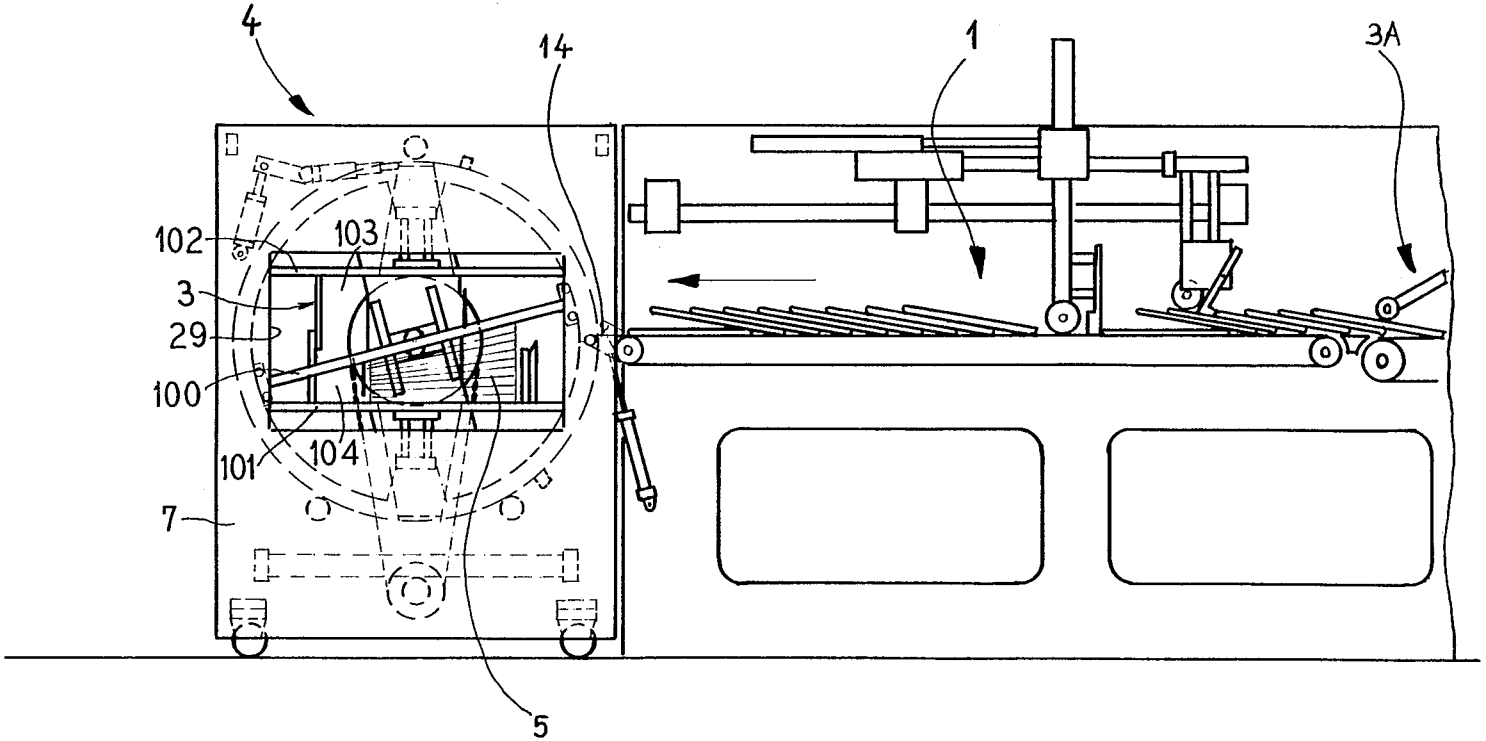
FIG. 1 is a schematic side view of a unit delivering folded boxes to the improved device of the present invention.

The principles of the present invention are particularly useful when incorporated in a piling device, generally indicated at 4 in FIG. 1, which has a double store or storage unit 3 for receiving batches 5 from a preparation station 1 that follows a delivery unit 3A of a device, such as a foldergluer. The blanks, as illustrated, are counted to the desired number by a known type of counter, and then transported on a conveyor of the delivery unit or preparation station 1 against a shelf or gate 14 to form the batch 5, which is then conveyed into one side or chamber of the double store 3 of the piling unit 4 after the gate 14 is lowered. After loading the first pile 5, the double store 3 is rotated through 180° to receive the second pile, which will be presented head-to-tail relative to the first pile.

Figure 2:
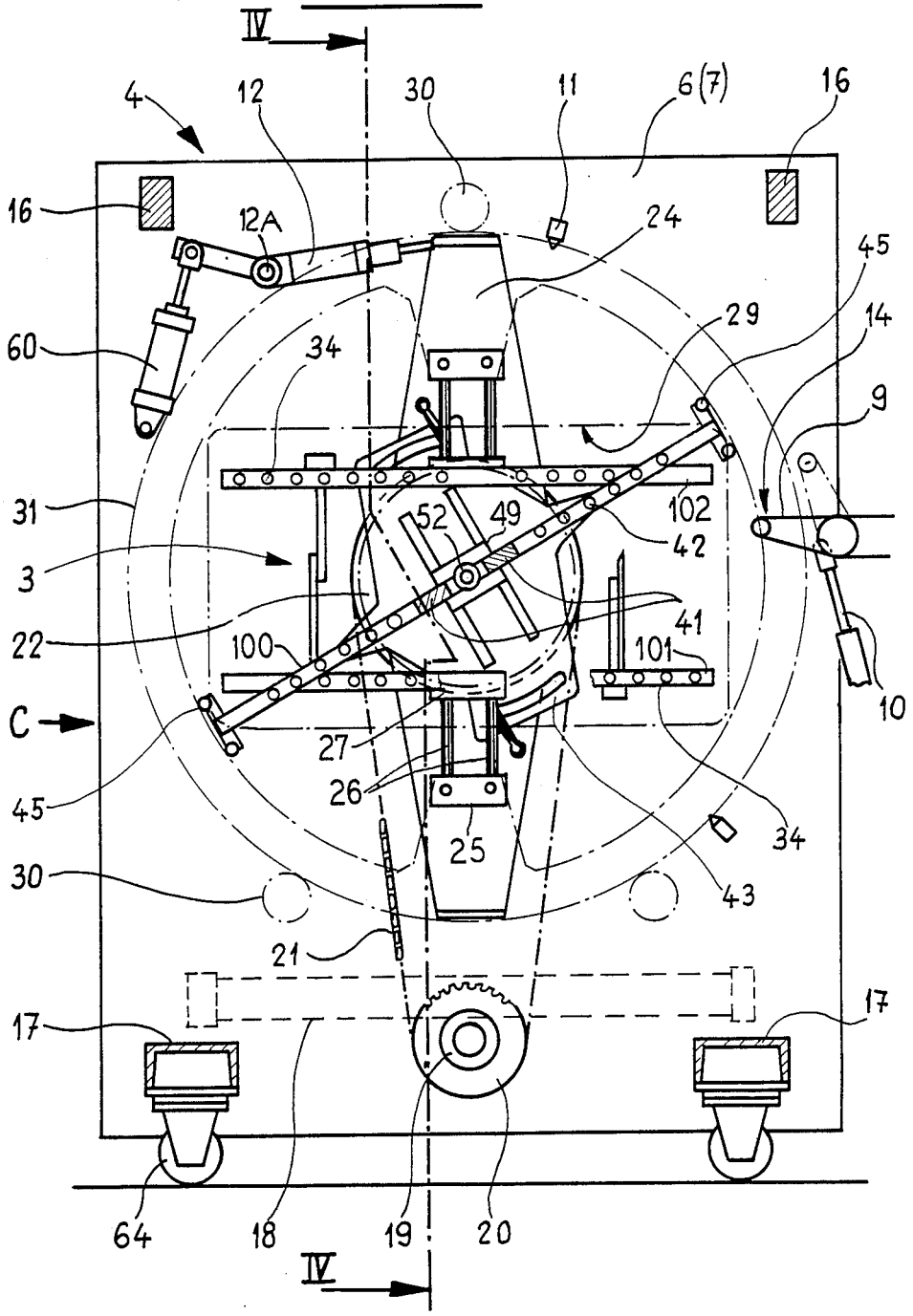
FIG. 2 is a side view, with portions broken away for purposes of illustration, of the improved piling device of the present invention.
Figure 3:
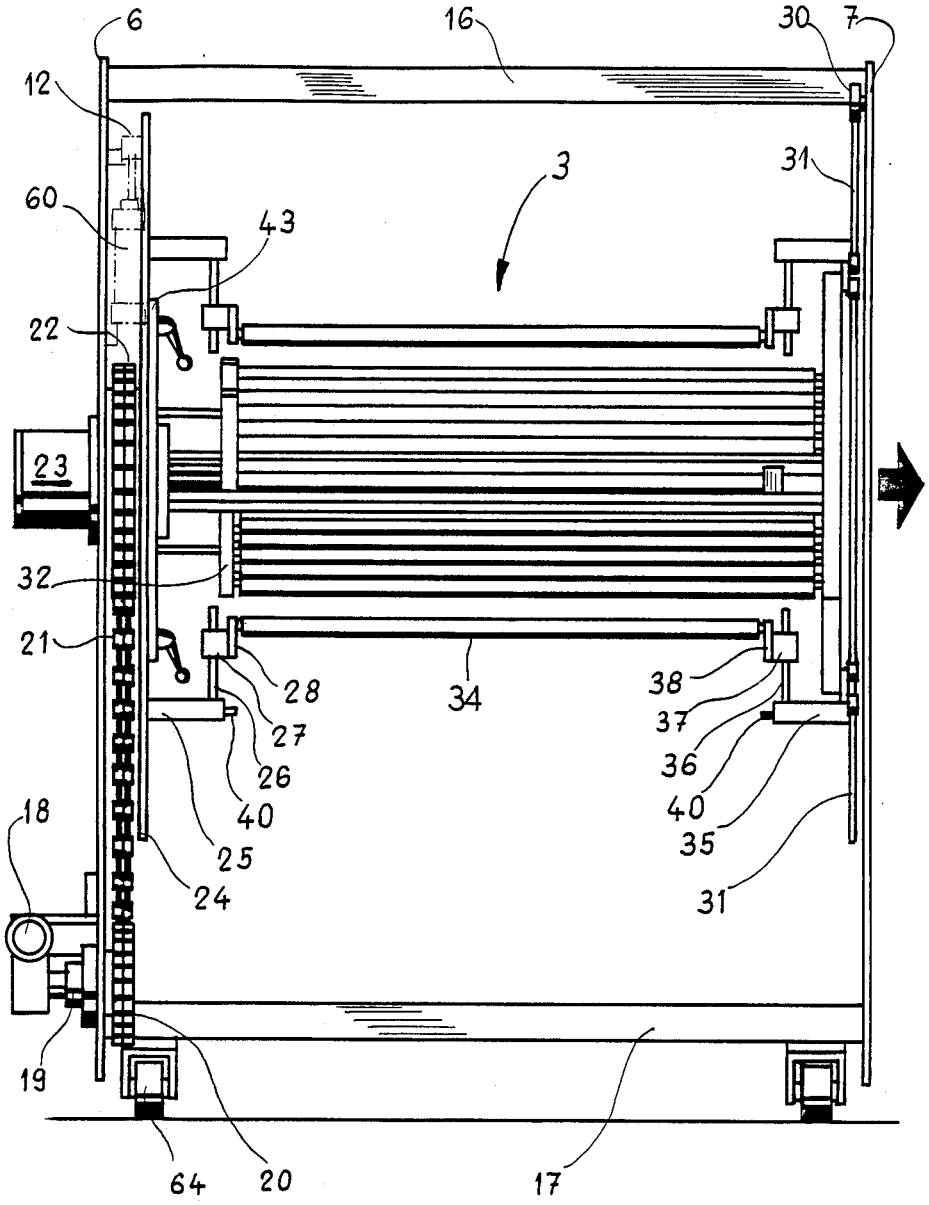
FIG. 3 is an end view of the device of FIG. 2, taken from the direction of the arrow C.
Figure 4:
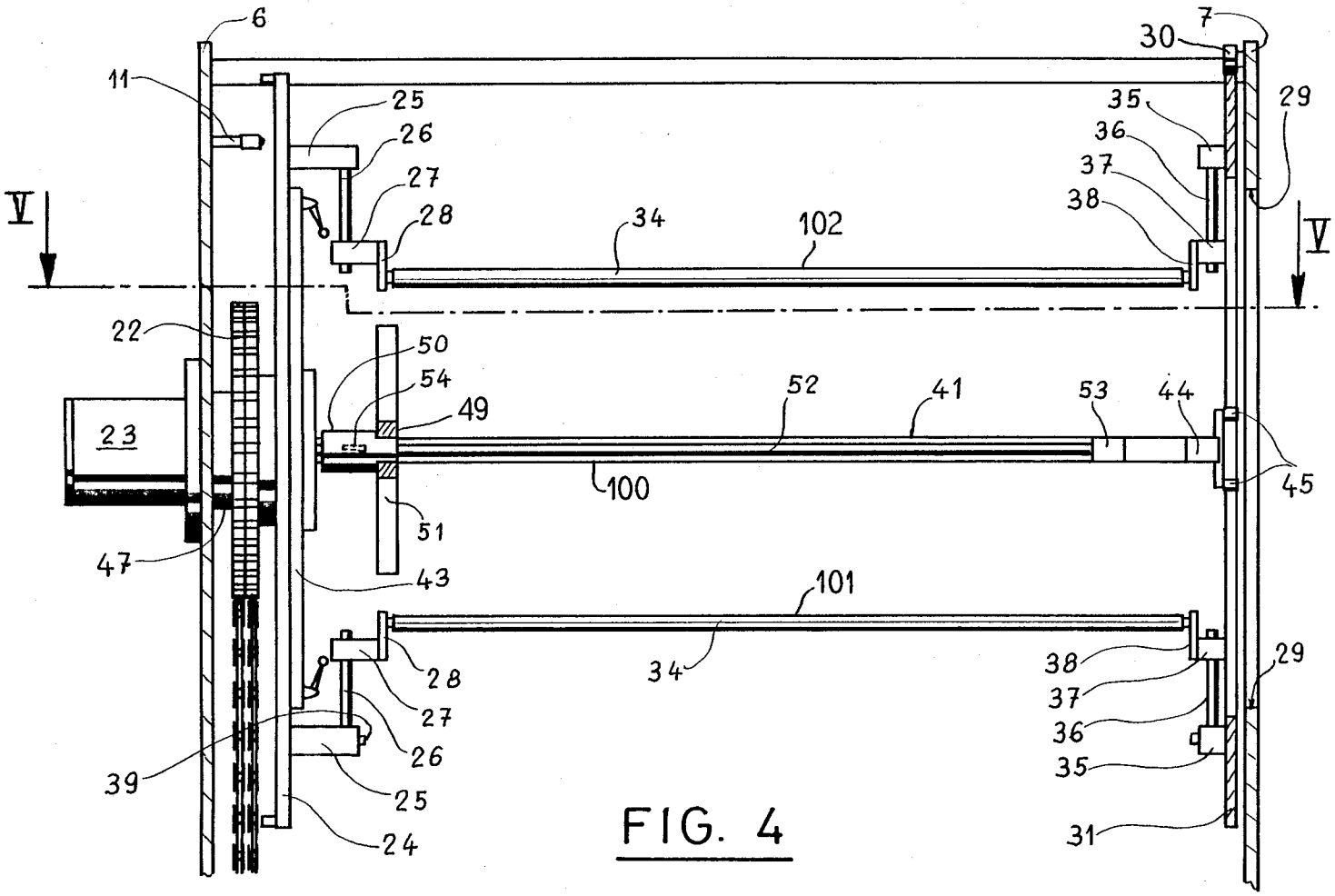
FIG. 4 is a cross sectional view taken along the lines IV—IV of FIG. 2.

The piling unit of device 4, as best illustrated in FIGS. 2 and 3, has two lateral frames 6 and 7, which are connected on the upper edge by a pair of crossbars 16 and adjacent the lower edge by a pair of crossbars 17. The lower crossbars 17 support rollers 64, on which the unit may be moved or rolled on the floor of the building. Between the outer frame formed by the frame members 6 and 7 and the crossbars 16 and 17, a double store 3 is mounted for rotation. The double store 3, as illustrated, has two groups 101 and 102 of rollers 34 which, as best illustrated in FIG. 3, has the rollers in each group extending in a plane between a pair of beams, such as 28 and 38. One set of rollers constitutes the lower part of the double store, whereas the other set of rollers constitutes an upper part. These two sets are mounted adjustably in an inner frame or sub-frame formed by a plate 24 and an annular ring or crown 31, which are best illustrated in FIGS. 2 and 4. The sub-frame of the double store is mounted for rotation around an axle defined by a hollow axle or tube 52 (FIG. 2). To rotate the sub-frame, a chain 21 is received on a sprocket wheel 22, which is connected to the sub-frame and the chain is also received on a pinion 20, which is on a shaft 19, which is rotated by a motor 18, which can be a motor actuating a rack attached to a piston, and cause rotation of the shaft 19 to rotate the gear and chain combination.

Since it is desirable to rotate the device through 180°, the frame member 6, as illustrated in FIGS. 2 and 4, is provided with a sensor 11, which senses the position of the rotating frame, such as by contact with the member 24, and causes a braking or stopping of the rotation. To help accomplish this, a piston 12 is mounted for pivotal movement around a pivot point 12A (FIG. 2). The piston 12 is connected by a lever to a piston 60 so that by actuation of the piston 60, the piston 12 will be shifted into and out of the path of the rotating sub-frame. When in the position illustrated, the piston engages a portion of the plate 24 to stop or arrest the rotation.

As mentioned hereinbefore, a gate 14 is provided on the end of the conveyor for the delivery station 1, and this gate is composed of two sheets 9 of metal, which are pivotally mounted for movement between the position illustrated and an upright position, shown in chain lines, by the actuation of a piston 10.

As mentioned before, the groups 101 and 102 of rollers 34 are arranged to lie in two separate planes, which are spaced apart. The spacing between the two planes can be changed or varied as desired. To provide this adjustable mounting, the plate 24 has a bearing block 25, while the ring-like element 31 has a block 35. As best illustrated in FIG. 2, the ring-like element 31 has two diametrically opposed projections on which the blocks 35 can be mounted, such as by screws 40 (FIG. 3). The block 25 is mounted by screws or threaded fasteners 40 onto the plate 24. The beams or end plates 28 and 38, respectively, are mounted on blocks 27 and 37, which have two axles, such as 26 or 36, respectively. As illustrated, the blocks 27 can move relative to the blocks 25 by movement of the axles. If the blocks 27 are secured on the axles 26, then the axles can move relative to the block 25 and can be secured in the desired position by a threaded fastener, such as 39 (see FIG. 4). The upper group, as illustrated in FIGS. 2, 3 and 4, is also adjustable in a similar fashion.

As previously mentioned, a portion of the frame for the double store includes an annular member 31, which has, basically, at least a rectangular opening corresponding to the rectangular size between the two parallel rows of rollers 34. The frame member 7, as illustrated in FIG. 4, has an opening 29, which corresponds to the opening in the annular ring element 31. As illustrated in FIG. 2 by chain lines, the opening 29 has a rectangular configuration. In order to mount the ring 31 on the member 7, the member 7 has three rollers 30, which engage the outer periphery of the ring 31.

As best illustrated in FIGS. 2 and 4, the space between the two groups 101 and 102 of rollers 34 are sub-divided by a separating device or partition 100, which extends diagonally between the two groups. The separating device has a pair of rails or guide members 41, which at one end have a cross member 32, and at the other end has a cross member 44. In addition, a plurality of rollers 42 are mounted to extend between the cross members 32 and 44.

Figure 5:
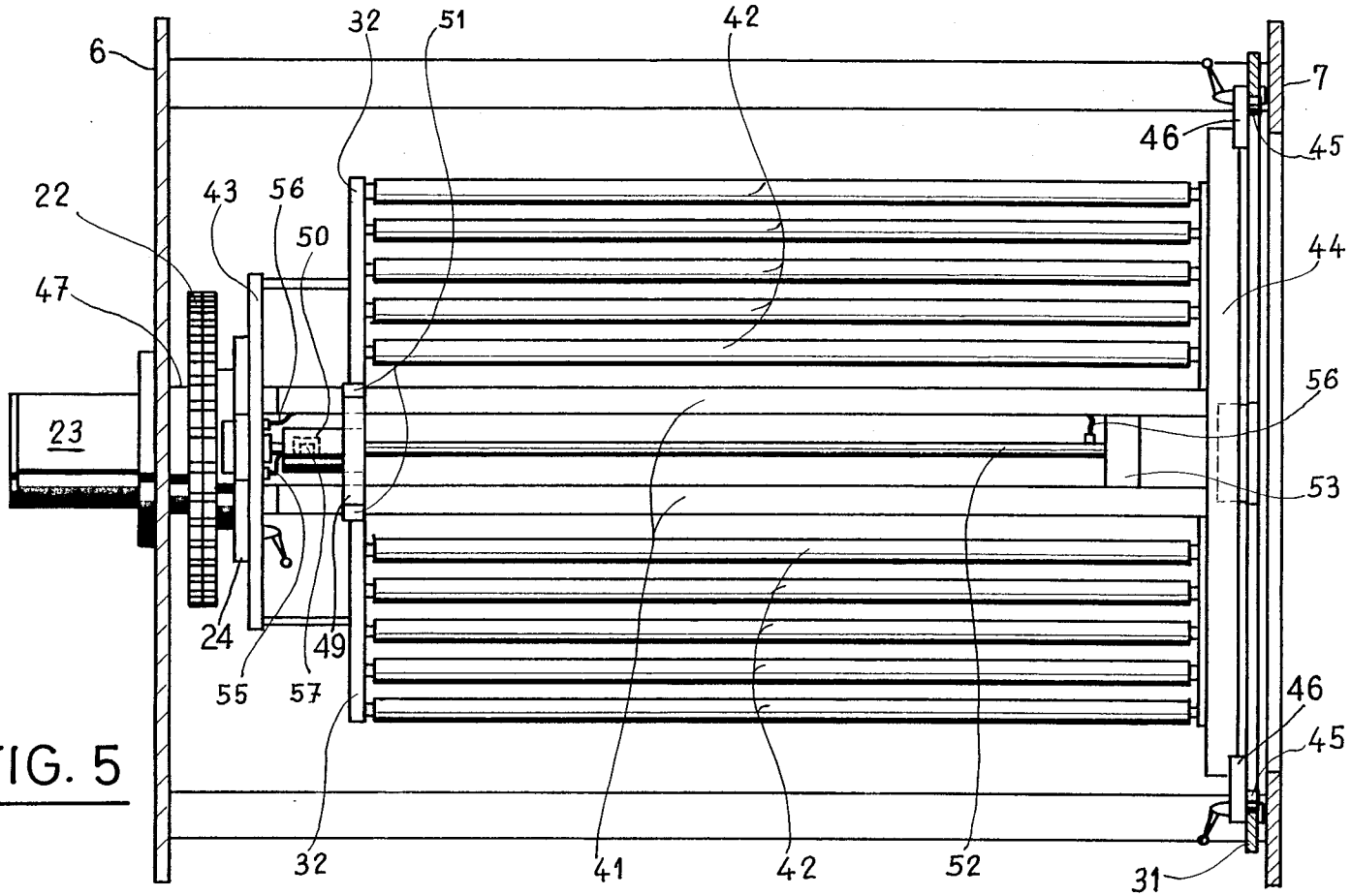
FIG. 5 is a cross sectional view taken along the lines V—V of FIG. 4.

The cross member 32 is mounted on a plate 43, which is mounted for adjustment onto the plate 24, as best illustrated in FIGS. 4 and 5. The beam or member 44, at each end, has adjustably mounted blocks 46, which carry roller bearings 45, which engage the inner periphery of the ring or crown 31. The blocks 46 have threaded devices for clamping the block in a given position so that, by loosening the clamping means of the block 46, and the clamping means on the plate 43, the angle of inclination of the separating device, relative to the planes of the two groups of rollers 34, can be changed within a certain angular range.

To support the plate 24 for rotation, it is mounted on a projection 47 of a rotatable pneumatic distributor 23. The projection 47 extends through the frame member 6 and is provided with ball bearings to allow rotation relative to the frame. As illustrated, the distributor 23 is mounted on the outside of the frame. Thus, the whole sub-frame having the double store 3 can rotate within the outer frame formed by the frame members 6 and 7.

As illustrated in FIG. 1, the separating device 100 coacts with the groups 101 and 102 to form spaces or chambers 103 and 104 for receiving the batches 5. After a batch 5 has been placed in each of the spaces 103 and 104, means are activated to move the batches along the axis of the tube 52 to be discharged out the opening 29. This means is best illustrated in FIGS. 4 and 5, and includes a carriage 49, which is mounted on a cylinder or sleeve 50 that slides along the tube 52 from the positions illustrated in FIG. 4, towards a cross member 53, that spaces apart the two rails 41. The carriage 49 also includes a pair of pusher elements 51, which project upward into each of the chambers 103 and 104, as best illustrated in FIG. 2. The carriage 49, when moving from the position illustrated in FIG. 4, towards the cross piece or bar 53 will slide on the surfaces of the two rails 41. To move the carriage from the position, a magnet 54 (FIG. 4) is received in the hollow tube or axle 52 and is formed as a piston, which will be shifted along the axis of the tube in response to air or pneumatic pressure, which is introduced to the tube 52 by lines 55 and 56. The cylinder 50 carries at least one magnet, such as 57, which is attracted to the magnetic piston 54 and, thus, moves the carriage with the piston 54 as it moves axially within the tube 52.

In operation, assuming that both the chambers 103 and 104 are empty, a first batch is formed and placed in the chamber 104, as illustrated in FIG. 1. Once the first batch has been formed and placed in the chamber 104, a sensor will cause an actuation of the piston 10 to raise the gate 14 to a blocking position. In addition, the drive means will be actuated to cause the double store 3 to be rotated through 180° to present the empty space 103 in the position of the space 104 of FIG. 1. Then, the gate 14 will be lowered to allow a second batch to be inserted into the space so that both chambers 103 and 104 are provided with batches. When this occurs, air is emitted in the tube 52 to cause the magnetic piston 54 to move left-to-right, as illustrated in FIG. 4, so that a carriage 49 will move towards the right to urge both batches out the opening 29 onto another carriage or into a bundling device, which is disposed adjacent the frame member 7. As the batch is clear, a sensor (not illustrated) causes changes in the air pressure to cause the carriage 49 to move toward the left back to the position illustrated in FIG. 4, so that the double store is ready to receive the next batch. It should be noted that the motor 18 referred to is a rack motor, in which a rack is moved in a longitudinal direction to cause rotation of the shaft. Thus, by reversing the direction of movement, the device will swing through a 180° arc. It is also possible to have a stepping motor or an arrangement which would rotate the device constantly in one direction through an arc of 180°.

Although various minor modifications may be suggested by those versed in the art, it should by understood that I wish to embody within the scope of the patent granted hereon all such modifications as reasonably and properly come within the scope of my contribution to the art.

I claim:

1. In a device for transporting and forming batches of flat pieces with decreasing thicknesses, which are received from a means for transporting the flow of batches with an accelerating conveyor belt and means for counting the batches, said device including storage means for receiving the batches, the improvements comprising a removable gate being positioned to block flow from the end of the conveyor belt, a double store mounted for rotation on an axis of rotation in a frame of the device, said store having two groups of rollers lying in two separate planes and an intermediate partition extending diagonally between said two planes to form two chambers, said store having an opening disposed adjacent one end aligned with an opening in a first side of the frame of the device, means for rotating said store, and means for removing the contents of both chambers simultaneously comprising a carriage shiftable on said partition along the axis of rotation and means for moving the carriage, said carriage having pusher elements extending into each of the chambers to push the contents through the opening in the first side of the frame of the device as the carriage is moved.

2. In a device according to claim 1, wherein one end of the store is formed by an annular member, said annular member being engaged by three rollers mounted on the first side of the frame around the opening for rotatably supporting that end of the double store.

3. In a device according to claim 1, wherein the means for moving the carriage includes a hollow tube having a magnetic piston, and pneumatic attachments for moving said piston axially in said tube.

4. In a device according to claim 1, wherein the means for rotating the double store include a chain wheel secured to one end of a sub-frame of the store, a chain extending from said chain wheel to a pinion mounted on an axle, said axle being engaged by a rack of a motor.

5. In a device according to claim 1, wherein the intermediate partition of the double store is composed of a plurality of rollers mounted between two end beams, one of said end beams being angularly adjustable by clamping means clamping the end beam on an annular ring member.

6. In a device according to claim 1, wherein the gate is composed of two sheets of metal.

7. A piling device for receiving batches of blanks from an end of a conveyor, said piling device comprising a main frame having an opening on one side, means mounting a sub-frame for rotation about an axis in said main frame, said sub-frame having two groups of rollers arranged in spaced apart planes and a partition extending diagonally between said two groups of rollers to form two chambers, means for moving batches from said chambers along the axis of rotation through said opening on the one side of the frame, said means for moving including a carriage mounted on a hollow axle provided on the axis of rotation, a magnetic piston disposed in said hollow axle and pneumatic means for shifting the magnetic piston and carriage along said axis.

8. A piling device according to claim 7, wherein the partition is mounted in said sub-frame to be angularly adjusted relative to the spaced apart planes.

9. A piling device according to claim 8, which includes means for adjusting the spacing between the two planes of rollers to change the size of the chambers.

* * * * *